US006123412A

United States Patent [19]

Yamamoto et al.

[11] Patent Number: 6,123,412

[45] Date of Patent: Sep. 26, 2000

[54] SUPERSONIC WAVE, INK JET RECORDING APPARATUS INCLUDING INK CIRCULATION MEANS

[75] Inventors: Noriko Yamamoto; Chiaki Tanuma; Shiroh Saitoh, all of Kanagawa-ken; Isao Amemiya, Tokyo; Hitashi Yagi, Kanagawa-ken, all of Japan

[73] Assignee: Kabushiki Kaisha Toshiba, Kawasaki, Japan

[21] Appl. No.: 09/038,152

[22] Filed: Mar. 11, 1998

[30] Foreign Application Priority Data

Mar. 14, 1997 [JP] Japan ..... 9-061387

[51] Int. Cl.[7] ..... B41J 2/135; B41J 29/38; B41J 2/045

[52] U.S. Cl. ..... 347/46; 347/10; 347/68

[58] Field of Search ..... 347/68, 46, 48, 347/72, 10; 310/317

[56] References Cited

U.S. PATENT DOCUMENTS

| | | | |
|---|---|---|---|
| 4,266,232 | 5/1981 | Juliana, Jr. et al. | 347/68 X |
| 4,325,255 | 4/1982 | Howard et al. | 310/317 X |
| 5,138,333 | 8/1992 | Bartky et al. | 347/68 X |
| 5,268,610 | 12/1993 | Hadimioglu et al. | 347/46 X |
| 5,629,724 | 5/1997 | Elrod et al. . | |
| 5,880,759 | 3/1999 | Silverbrook | 347/48 X |
| 5,903,286 | 5/1999 | Takahashi | 347/68 X |
| 5,912,679 | 6/1999 | Takayama et al. | 347/10 |
| 6,036,301 | 3/2000 | Amemiya et al. | 347/46 |

FOREIGN PATENT DOCUMENTS

| | | | |
|---|---|---|---|
| 550192A2 | 7/1993 | European Pat. Off. | 347/46 |
| 5-38809 | 2/1993 | Japan | 347/68 |
| 6-31911 | 2/1994 | Japan . | |

*Primary Examiner*—Susan S. Y. Lee

*Attorney, Agent, or Firm*—Finnegan, Henderson, Farabow, Garrett & Dunner, L.L.P.

[57] ABSTRACT

An ink jet recording apparatus uses supersonic waves focused on an ink holding container to inject ink from the ink surface onto a recording medium. A piezoelectric element driven by a first driving signal serves as the supersonic wave generator. The piezoelectric element can also be driven by a second driving signal to effectively circulate the ink in the holding container. The second driving signal results in an acoustic pressure at the ink surface lower than the acoustic pressure necessary for injecting the ink onto a recording medium.

20 Claims, 3 Drawing Sheets

SUPERSONIC WAVE, INK JET RECORDING APPARATUS INCLUDING INK CIRCULATION MEANS

BACKGROUND OF THE INVENTION

1. Field of the Invention

This invention relates to an ink jet -recording apparatus for recording an image by transforming a liquid ink to droplets and injecting them onto a recording medium, and more particularly to an ink jet recording apparatus for recording an image on a recording medium by injecting ink droplets by the pressure of supersonic beams irradiated from a piezoelectric element.

2. Description of the Related Art

An apparatus for recording an image by transforming a liquid ink to small droplets and injecting them onto a recording medium has been used practically as an ink jet printer. Although various ink jet printers were invented up to now, a type in which ink droplets are injected by a pressure of vapor generated by heat of a heating body, disclosed in Japanese Patent Publication (Kokoku) No.56-9429 and No. 61-59911 and a type in which ink droplets are injected by pressure pulses mechanically generated by a piezoelectric body, disclosed in Japanese Patent Publication (Kokoku) No. 53-12138 are typical methods known up to now.

However, because in the ink jet printers of these types, an ink is injected from an end of a nozzle, an ink liquid is likely to be locally condensed due to vaporization of a solvent in the ink, thereby leading to clogging of individual fine nozzles corresponding to each resolution.

To overcome these disadvantages, supersonic wave methods in which, an ink is injected from the ink surface by a pressure of supersonic wave beams generated from an piezoelectric element, have been proposed in *IBM TDB,* Vol. 16, No.4, pp.1168 (1973-10), Japanese Patent Disclosure No. 63-166548, Japanese Patent Disclosure No.63-312157, Japanese Patent Disclosure No. 2-184443 and the like. Because this supersonic wave method is a nozzleless type which does not require individual nozzles for each dot size and partition walls for ink path, this provides an effective structure for preventing the clogging which is a large obstacle for forming of a line head. Further, because this method is capable of generating and injecting very small diameter of ink particles stably, this is suitable for higher resolution type.

In the ink jet recording apparatus using a liquid ink, if it is left not used for a long time, injection of the ink droplets becomes unstable so that deterioration of recorded image quality is induced. According to the related art, to overcome the unstable injection of the ink liquid as described above, a method in which an ink liquid is injected to other area than a recording medium every predetermined time so as to introduce the ink liquid to initial state and a method in which an ink in the nozzle is forcibly sucked into the outside of ink holding means by a pump or the like have been utilized. However, in these cases, the apparatus becomes complicated.

SUMMARY OF THE INVENTION

The present invention has been proposed to solve the above problems of the related art, and it therefore is an object of the invention to provide an ink jet recording apparatus for injecting ink droplets by pressure of supersonic waves, the ink jet recording apparatus being capable of easily transforming an ink liquid to a state appropriate for image recording even after the apparatus is left not used for a long time, and recording high-quality images from the initial time of printing.

To achieve the above object, the present invention provides an ink jet recording apparatus comprising:

an ink holding means for holding an ink liquid; a supersonic wave generating means composed of a piezoelectric element acoustically connected to the ink liquid;

a supersonic wave focusing means for focusing supersonic waves generated from the piezoelectric element;

an ink injection driving means for applying a first driving signal to the piezoelectric element so that the focused supersonic waves inject an ink from a surface of the ink liquid; and an ink liquid circulation means for applying a second driving signal to the piezoelectric element so that an acoustic pressure of the focused supersonic waves on the surface of the ink liquid is made smaller than an acoustic pressure necessary for injecting the ink, whereby circulating the ink liquid within said ink holding means.

In the ink jet recording apparatus for injecting ink droplets by irradiation pressure of supersonic waves, by applying a predetermined intermittent high frequency voltage (burst wave) to the piezoelectric element forming the supersonic wave generating means, a standing wave is created between the ink surface and the piezoelectric element or an acoustic lens as a supersonic wave focusing means formed on the piezoelectric element. This standing wave is focused in the vicinity of the ink surface by the supersonic wave focusing means. At a position where supersonic waves are focused, the ink surface is swollen in the form of a cone so as to create a meniscus and then, before the standing wave is diminished, ink droplets having a diameter corresponding to the wavelength of a supersonic wave are separated and injected from a vertex of the meniscus and then the standing wave is diminished.

As described above, when the ink surface level is kept in an appropriate and excellent condition for recording of an image (injection of ink droplets), the ink droplets are injected stably. However, in printing motion after a long down time, viscosity and surface tension locally change due to evaporation of a solvent in the ink liquid. In the case of pigment ink, the dispersion equality of the pigment is lost, so that the sound wave transmission characteristic becomes uneven, and consequently, supersonic waves are not focused or other problems occur. Particularly if the pigment in the ink is deposited on an acoustic lens while the recording apparatus is not used for a long time, the supersonic waves are not focused at all.

To solve a problem of deterioration of image quality due to unstable injection of the ink liquid because of a change in ink physical properties, the present inventors attempted to disperse pigment particles in water so that motion of fine particles in the ink liquid can be observed visually and, regarding this solution as the ink liquid, observed the behavior of ink droplet formation carefully.

As a result, if supersonic waves are irradiated from a piezoelectric element and focused in the vicinity of the ink surface, it was made evident that not only ink droplets were injected, but also the pigment particles were moved to a place where the supersonic waves were focused so as to produce a large pressure, so that the ink liquid was circulated within the ink holding means. This phenomenon was also observed under a driving condition capable of obtaining a supersonic beam power less than a threshold of an energy necessary for injection of the ink droplets and as small as for moving the ink surface slightly.

Thus, according to the present invention, the ink is circulated within the ink holding means to eliminate local changes of ink physical properties due to drying. For this purpose, a different signal (second driving signal) from a signal for image recording (ink droplet injection) (first driving signal) is applied to a piezoelectric element, so that supersonic waves as generated circulate the ink liquid within the ink holding chamber.

The second driving signal is not restricted to any particular type as long as it is a different signal from the first driving signal and further, it is such a piezoelectric element driving signal in which the acoustic pressure on the ink surface of the supersonic wave generated from the piezoelectric element is less than the acoustic pressure necessary for ink injection, namely which circulates the ink liquid within the ink holding chamber without injection of the ink liquid.

Usually, it is preferred that the second driving signal is applied at the time of no image formation and further, or when the ink surface level is below that at the time of image formation.

DETAILED DESCRIPTION OF THE PREFERRED EMBODIMENTS

Figure 1:
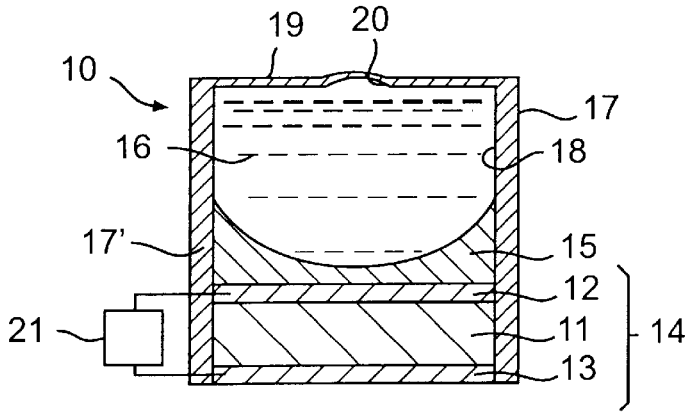
FIG. 1 is a schematic sectional view of an ink jet recording apparatus according to a first embodiment of the present invention.

Hereinafter, the embodiments of the present invention will be described with reference to the accompanying drawings. Throughout this specification, the same components are referred to by the same reference numerals.

FIG. 1 is a sectional view showing an ink jet recording apparatus according to a first embodiment of the present invention. An ink jet recording apparatus 10 shown in FIG. 1 is a so-called single head type apparatus. This recording apparatus 10 comprises a piezoelectric element 14 composed of a flat shaped piezoelectric body 11 in which electrodes 12, 13 are formed on both opposing upper and lower sides thereof. A supersonic focusing means 15 is disposed on the piezoelectric element 14. The piezoelectric element 14 and supersonic focusing means 15 are enclosed with side walls 17, 17'. Above the supersonic focusing means 15 is formed an ink holding chamber 18 for holding an ink liquid 16 between the side walls 17 and 17'. The ink holding chamber 18 is closed by an upper lid 19 and a circular opening 20 for injecting the ink liquid 16 is formed on the upper lid 19. Driving circuit 21 is provided for driving piezoelectric element 14.

The piezoelectric body 11 is formed of a material capable of producing supersonic waves by a predetermined driving signal applied across the electrodes 12 and 13. Examples of such piezoelectric materials include ZnO, $Pb(ZrTi)O_3$, $LiNbO_3$, ceramic piezoelectric materials such as quartz and the like, piezoelectric polymers such as copolymers of vinylidene fluoride and trifluoroethylene and the like.

The electrodes 12, 13 to be formed on the piezoelectric body 11 can be formed by forming a thin film of titanium, nickel, aluminum, copper, gold or the like by vapor deposition or sputtering, or printing a mixture of a glass frit and a silver paste by the screen printing method and baking it.

The frequency of supersonic wave to be generated varies depending on the type of the piezoelectric material and shape of the piezoelectric body and the diameter of ink droplets injected varies depending on the magnitude of the frequency of supersonic wave. The smaller the diameter of the ink droplets, the higher the resolution of an image becomes. To obtain a high-resolution image, the diameter of ink droplets is preferably set from 3 to 150 $\mu$m. For this purpose, it is preferred to select a material and shape of the piezoelectric body so that the frequency of supersonic wave is approximately from 10 to 500 MHz.

The supersonic focusing means 15 provided on the piezoelectric element 14 is not restricted to any particular type as long as it is capable of focusing supersonic wave generated by the piezoelectric element 14 onto a liquid surface of the ink liquid 16 acoustically connected to the piezoelectric element 14. In an example shown in FIG. 1, the supersonic focusing means 15 is composed of a concave acoustic lens.

The electrodes 12, 13 formed on both sides of the piezoelectric body 11 are connected to a driving means 21 which applies the first and second driving signals which will be described in detail later.

The ink liquid 16 is not restricted to any particular type as long as it is injected by supersonic wave focused on an ink surface for recording an image on a recording medium. For example, dye inks and pigment inks using water as a solvent can be used, however, pigment inks having an excellent water resistance and color-fastness are preferably used as the ink liquid 16.

The opening portion 20 provided on the upper lid 19 of the ink holding chamber 18 is disposed at a position corresponding to a focusing position of the supersonic focusing means 15 and ink droplets are injected through this opening portion 20. If this opening portion 20 is narrow, even if the amount of the ink liquid 16 changes, the ink surface can be maintained at the same position as the opening portion 20 by means of a surface tension. Although the holding force of the ink liquid surface increases as the opening portion 20 is made narrower, it is preferred that the size of the opening portion 20 is larger than a width which is double the size of the ink droplet to be injected. The reason is that, when supersonic waves focused on the ink surface swell the ink surface so as to form a meniscus and then ink droplets are injected from a vertex of this meniscus, a new meniscus will be formed smoothly. The opening portion preferably has a diameter of not larger than 1.5 mm, and more preferably not larger than 1 mm.

Figure 2:
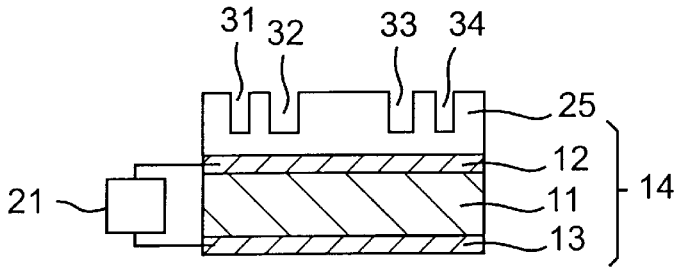
FIG. 2 is a schematic sectional view showing a part of an ink jet recording apparatus according to a second embodiment of the present invention.

FIG. 2 shows the same structure as the ink jet recording apparatus shown in FIG. 1 except that the supersonic focusing means contains a one-dimensional Fresnel lens 25 (the side walls 17, 17', ink liquid 16 and upper lid 19 are omitted here).

In the Fresnel lens 25, a plurality of parallel grooves (grooves 31–34 in FIG. 2) having a predetermined pitch according to Fresnel's theory of orbicular zone shifts the phase of supersonic waves irradiated from the top face and bottom face of the grooves by π. If such Fresnel lens 25 is formed of material having an acoustic impedance value between the acoustic impedance of the piezoelectric element 14 and the acoustic impedance of the ink liquid 16, the Fresnel lens 25 acts as an acoustic matching layer for acoustically matching the piezoelectric element 14 with the ink liquid 16, thereby making it possible to reduce damping of transmitted supersonic wave. As such acoustic matching material, it is possible to use polymeric materials such as epoxy resins, polyimides, or a mixture thereof with powdered alumina or tungsten.

Figure 3:
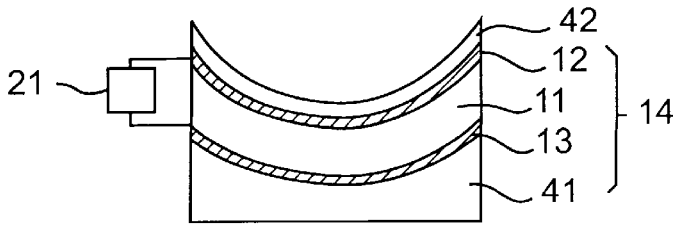
FIG. 3 is a schematic sectional view showing a part of an ink jet recording apparatus according to a third embodiment of the present invention.

FIG. 3 shows an example in which the supersonic focusing means is composed of the piezoelectric element 14 (in FIG. 3, the side walls 17, 17', ink liquid 16 and upper lid 19 are omitted). That is, in this recording apparatus, the piezoelectric element 14 is formed on a backing member 41 the top face of which forms a concave shape capable of focusing supersonic waves at a predetermined focal point. The piezoelectric element is curved along the concave shape of the backing member 41. On the surface of the electrode 12 formed on the top face of the piezoelectric body 11 is provided an acoustic matching layer 42 formed of the acoustic matching material as described above about the Fresnel lens of FIG. 2.

The acoustic matching layer 42 may be formed of silicon dioxide according to the sputtering or CVD method.

Figure 4:
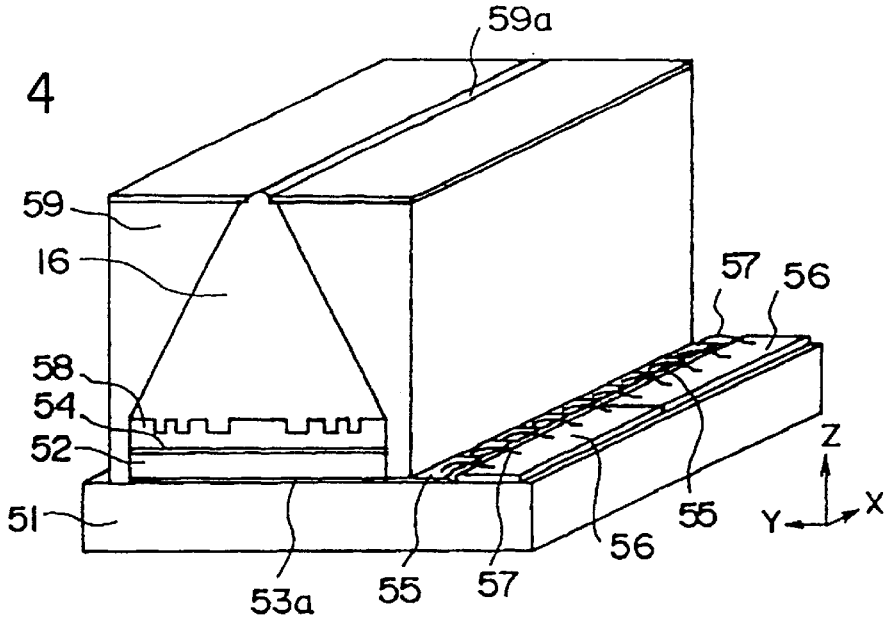
FIG. 4 is a schematic perspective view of an ink jet recording apparatus according to a fourth embodiment of the present invention.
Figure 5:
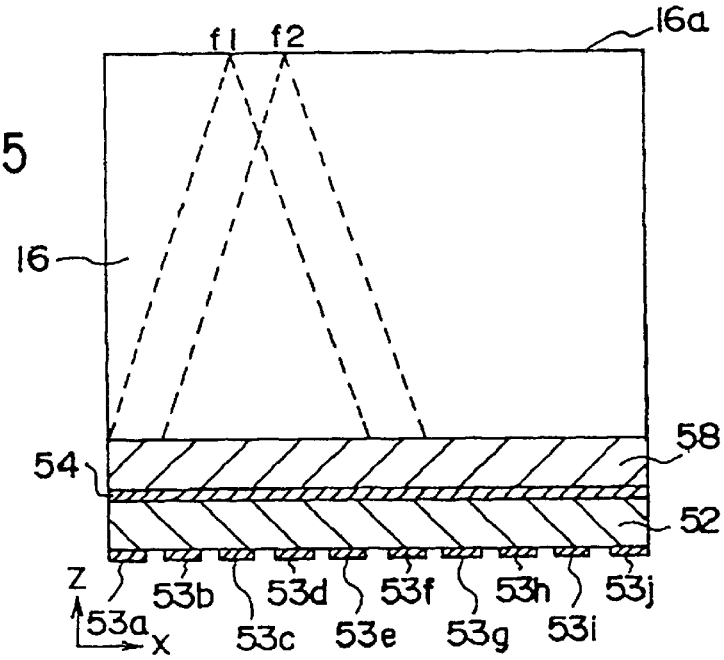
FIG. 5 is an enlarged sectional view of a plane including a focusing position of an acoustic lens parallel to a plane created by X-axis and Z-axis of the recording apparatus of FIG. 4.

FIG. 4 is a perspective view of the ink jet recording apparatus having a plurality of the piezoelectric elements disposed in the form of an array. FIG. 5 is an enlarged sectional view of a plane which is parallel to a plane created by the X-axis and Z-axis of the recording apparatus of FIG. 4 and includes focusing positions of the acoustic lens. In the ink jet recording apparatus shown in these figures, a flat piezoelectric body 52 which constructs a supersonic wave generating means is provided on a supporting member (backing member) 51. The piezoelectric body 52 can be formed of the piezoelectric material as described above about the piezoelectric body 11 of FIG. 1.

On the bottom surface of the piezoelectric body 52 are formed a plurality of individual electrodes 53*a* to 53*j* (hereinafter these individual electrodes are collectively indicated by reference numeral 53) in the same length as the width of the piezoelectric body 52. The piezoelectric body 52 is divided to a plurality of arrays in terms of function by these individual electrodes 53*a* to 53*j*. On the other hand, a single common electrode 54 is formed on the overall top face of the piezoelectric body 52. The electrodes 53, 54 can be formed of the same material as already described about the electrodes 12, 13 of FIG. 1.

On an end portion of the supporting member 51 are formed a plurality of array electrodes 55 at the same intervals as the individual electrodes 53 formed on the bottom face of the piezoelectric body 52. The respective array electrodes 55 on the supporting member 51 are neatly press-fitted to the individual electrodes 53 by using a conductive adhesive and electrically connected to the individual electrodes 53. The array electrodes 55 on the supporting member 51 are connected to a driving circuit 56 disposed on an end portion of the supporting member 51 through a bonding wire 57. The common electrodes 54 formed on a top face of the piezoelectric body 52 are connected to the driving circuit 56 by wiring (not shown).

A one-dimensional Fresnel lens 58 as an acoustic lens acting as an acoustic matching layer at the same time is provided on the piezoelectric body 52 through the common electrode 54. The Fresnel lens 58 is formed by forming grooves at a predetermined pitch according to Fresnel's theory of orbicular zone as explained about the Fresnel lens 25 of FIG. 2. The grooves are formed in parallel to the arrangement direction (main scanning direction: X-axis direction) of the piezoelectric elements functionally divided by the individual electrodes 53.

Referring to FIG. 4, an ink holding chamber 59 for holding the ink liquid 16 adjacent to the Fresnel lens 58 is formed on the supporting member 51. In this ink holding chamber 59, its side walls enclosing the ink liquid 16 extend from both ends of the Fresnel lens obliquely towards the upper direction such that they meet each other. A slit 59*a* is formed on the upper portion of the side walls such that it is opened outside. A width of the slit 59*a* is preferably not larger than 1.5 mm, and more preferably not larger than 1 mm for the same reason as that described about the opening portion 20 of the upper lid 19 of FIG. 1.

In the ink jet recording apparatus shown in FIGS. 4 and 5, supersonic waves are focused by means of the Fresnel lens 58 in Y-Z plane, while, in X-Z plane, a group of plural individual electrodes simultaneously driven (in FIG. 5, for example, five individual electrodes 53*a* to 53*e*) is driven at such a timing that the phase of supersonic waves generated from each of the piezoelectric elements corresponding to each of the individual electrodes becomes the same phase at a point on the ink surface 16*a* so as to inject ink droplets (not shown) from the ink surface 16*a*. In this case, by setting plural groups of individual electrodes simultaneously driven, it is also possible to inject ink droplets from plural positions at the same time.

The ink jet recording apparatus having the array piezoelectric element group having the structure shown in FIGS. 4 and 5 has the following advantages as compared to the single head type recording apparatus shown in FIGS. 1 to 3.

That is, when a two-dimensional image is formed using a single head type recording apparatus, the head is mechanically moved in a direction perpendicular to the moving direction of an ordinary recording medium. In this method, in a case when mechanical vibration occurs or a density of pixels is intended to be increased, fine adjustment or complicated control is required for moving of the head, so that complication or enlarged size of the apparatus or other problems are induced. On the contrary, in a case when a plurality of the piezoelectric elements are disposed in the form of array, ink injection position can be controlled by electronic control so that the above problems can be solved.

Referring to FIG. 5, in order to inject ink droplets from a predetermined position, for example, the afore-mentioned group of individual electrodes simultaneously driven (53*a* to 53*e*) is driven at such a timing that the phase of supersonic waves becomes the same phase on the ink surface above the electrode 53*c* so as to focus them at a position f1 as shown by a dotted line in FIG. 5. Next, a group of the electrodes 53*b*–53*f* is driven at such a timing that the phase of supersonic waves becomes the same phase on the surface above the electrode 53*d*. Consequently, the ink droplet injection position can be shifted by the amount of a single electrode. That is, the supersonic waves are focused at a position f2. By shifting the group of the individual electrodes simultaneously driven successively one by one, the ink droplet injection position can be shifted.

In the ink jet recording apparatus of the present invention, an image recording signal (first driving signal) is supplied from the driving circuit (driving circuit 21 in FIGS. 1 to 3, driving circuit 56 in FIG. 4) to the piezoelectric element, so that supersonic waves are focused on the ink surface by each acoustic lens (supersonic wave focusing means) so as to inject ink droplets. As regards focusing of supersonic waves on the ink surface according to the present invention, as long as the supersonic waves are focused so sufficiently that the ink droplets can be injected, even if the focal point of the supersonic wave focusing means is different from the ink surface, there is no problem. Concretely, if a difference $\Delta d$ between a distance between the ink surface and the top face of the supersonic wave focusing means and the focal length of the supersonic wave focusing means has a relation of $\lambda \leqq \Delta d \leqq 20\lambda$ where $\lambda$ is the wavelength of supersonic wave in the ink liquid, the supersonic waves are focused on the ink surface, so that ink droplets are injected.

According to the present invention, if the aforementioned first driving signal, which is applied to the piezoelectric body 11 from the driving circuit through the electrodes 12, 13 so as to produce supersonic waves from the piezoelectric element 14, is a driving signal capable of applying a sufficient voltage for injecting the ink droplet corresponding to an image recording signal, it is not restricted to any particular signal. For example, explaining a case when one ink droplet is injected, an intermittent high frequency voltage (burst wave) is applied at a frequency in which the wavelength of sonic wave in the ink liquid is 3 to 150 $\mu$m in an interval of 0.5 to 200 $\mu$sec. As a result, a standing wave is produced between the ink surface and the piezoelectric element or the acoustic lens formed on the piezoelectric element. This standing wave is focused on the ink surface by the supersonic wave focusing means. At the supersonic wave focusing position, the ink liquid surface is swollen in the form of a cone so as to form a meniscus. Before the standing wave is damped, ink droplets of a diameter corresponding to the wavelength of supersonic wave are separated and injected from the vertex of the meniscus and then the standing wave is diminished.

If the ink surface is kept in an excellent condition, the ink droplets are injected stably. In the printing operation after long down time, the viscosity and the surface tension of the solvent in the ink liquid are locally changed, or if a pigment ink is used, the dispersion equality of the pigment is lost, so that supersonic wave transmission characteristic becomes unequal. As a result, the supersonic waves are not focused or other problem occurs, or if the pigment is deposited on the acoustic lens, the supersonic waves are never focused.

Figure 7A:
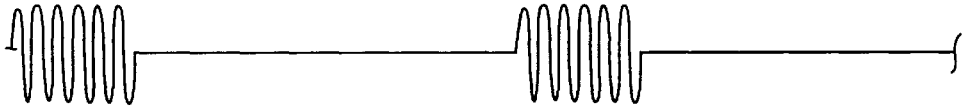
FIGS. 7A to 7D are waveform diagrams showing some examples of a second driving signal for use in the present invention.

Therefore, according to the present invention, besides the first driving signal, another driving signal (second driving signal) for circulating the ink liquid within the ink holding chamber without injecting ink droplets is applied to the piezoelectric element. This second driving signal is not restricted to any particularly type as long as it is capable of achieving the circulation of the ink liquid within the ink holding chamber without injecting ink droplets. For example, this second driving signal is a driving signal in which the peak value (voltage value) of the burst wave is made lower than the driving condition for injecting ink droplets as shown in FIG. 7A. Such a voltage value in which no ink droplet is injected and ink circulation is effectively carried out is investigated and this voltage can be applied in an appropriate time interval prior to the start of the printing. This method has such an advantage that no separate clock circuit is required because the applying frequency of the burst wave can be made equal to the frequency of dot printing.

Figure 7B:
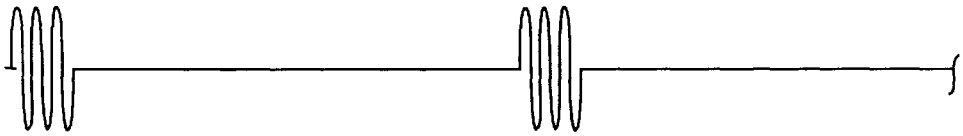

FIG. 7B shows an example of an ink liquid circulating signal (second driving signal) in which the wave number (time) of the burst wave is made lower than the driving condition for injecting the ink droplets. According to this example, a wave number in which the ink circulation is effectively carried out without injecting any ink droplet is investigated and this wave is applied in an appropriate time interval prior to the start of the printing. This method has such an advantage that no separate clock circuit is required because the applying frequency of the burst wave can be made equal to the frequency of dot printing. Further, because the peak value of the burst wave can be made the same as the ink liquid injection condition, a high frequency signal source can be used in common.

Figure 7C:
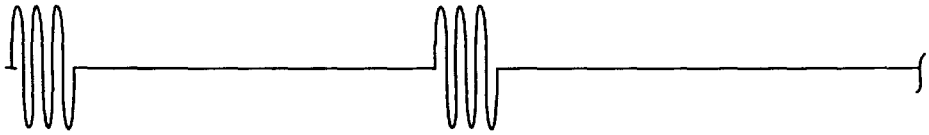

FIG. 7C is an example of an ink circulation signal (second driving signal) in which the frequency of the burst wave is different, indicating a wave in which the peak value of the burst wave is lower than the ink droplet injection condition and/or the wave number thereof is smaller than the ink droplet injection condition.

Figure 7D:
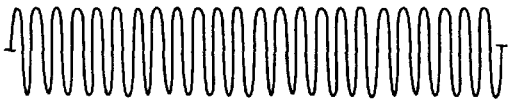

FIG. 7D is an example of an ink circulation signal (second driving signal) by continuous waves, and in this case, a voltage lower than its threshold value in which no ink droplet is injected is applied.

As described above, according to the present invention, the second driving signal to be applied for circulation of the ink liquid has a lower voltage than the image forming signal (first driving signal) or a smaller number of burst waves or may have both conditions. Even if the voltage is high, this is acceptable if the number of burst waves is decreased. Further, it is permissible to drive with continuous waves at low voltage. To circulate the ink liquid, it is necessary to apply these signals for about several seconds, not but pulse waves. On the other hand, in order to ensure a high ink liquid circulation efficiency, the driving frequency is preferably within a resonant frequency range inherent of the piezoelectric element or harmonic component. If the burst wave is used for driving, its frequency is desired to be as short as possible.

Further, in order to circulate the ink liquid within the ink holding chamber 59, next system may be employed. That is, as described referring to FIG. 5, a group of individual electrodes simultaneously driven (53*a* to 53*e*) is driven at such a timing that the phase of supersonic waves becomes the same phase on the ink surface above the electrode 53*c* so as to focus them at a position f1 as shown by a dotted line in FIG. 5. The acoustic pressure of the focused supersonic waves on the ink surface is made smaller than an acoustic pressure necessary for injecting the ink so as to circulate the ink liquid within the ink holding chamber 59.

Next, a group of the electrodes 53*b*–53*f* is driven at such a timing that the phase of supersonic waves becomes the same phase on the surface above the electrode 53*d*. Consequently, the ink liquid circulation position can be shifted by the amount of a single electrode. That is, the supersonic waves are focused at a position f2. By shifting the group of the individual electrodes simultaneously driven successively one by one, the ink liquid circulation position can be shifted.

It is depending on the uneven state of the ink liquid, for example the position of an uneven portion of the ink liquid within the ink holding chamber 59, to decide whether or not the ink liquid circulation position should be shifted. It is preferable to shift the ink liquid circulation position (scan a supersonic beam) on an uneven portion of the ink liquid (particularly the vicinity of the slit 59*a*) in order to circulate the ink liquid more efficiently.

In any case, the second driving signal can be supplied from a driving circuit (driving circuit 21 in FIGS. 1 to 3, driving circuit 56 in FIG. 4) for applying the first driving signal to the piezoelectric element.

Hereinafter, the present invention will be described with reference to the following Examples.

EXAMPLE 1

In this example, an ink jet recording apparatus having a structure shown in FIG. 2 was produced in the following way.

First, as the flat piezoelectric body 11, one made of a lead titanate-based ceramic was used and its thickness was adjusted so that its resonant frequency of vibration was 50 MHz. A Ti/Au laminated electrode was formed by 0.05 μm and 0.3 μm in thickness, respectively on the both sides of this piezoelectric body 11 by the sputtering method and the piezoelectric element 14 was produced by electric polarization.

An effective bore of the piezoelectric element 14 was 1.4 mm.

The Fresnel lens 25 was produced by forming grooves by reactive ion etching (RIE) on glass plate at a predetermined pitch based on the Fresnel's theory of orbicular zone so that the focal length was 3.3 mm.

Then, the electrodes 12, 13 were connected to the driving circuit 21 and the ink liquid (dye ink) was filled in the ink holding chamber 18, so that the recording apparatus was completed.

Figure 6:
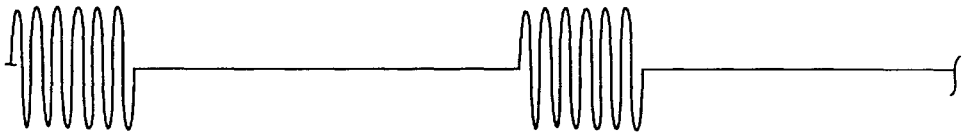
FIG. 6 is a waveform diagram showing an example of a first driving signal for use in the present invention.

Then intermittent series sine waves (burst waves) as shown in FIG. 6 were applied to the piezoelectric element 14 of the recording apparatus from the driving circuit 21 so as to form ink dots, thereby obtaining an image. Intervals of the burst waves were changed appropriately according to the image data. In this embodiment, the ink droplets were injected under the condition that the applied voltage was 20 Vpp and the burst wave number was 1500.

Using such an ink jet recording apparatus, the stability of the initial printing operation phase after a motion-free state for a long down time was investigated depending on whether or not the ink liquid circulation was attained. That is, each of two ink jet recording apparatuses produced as described above was prepared, and a dye ink was filled therein, followed by allowing to stand for two hours with no cover being placed on the opening portion to expose the ink surface to the atmosphere. After that, the ink liquid was filled in the ink holding chamber of each recording apparatus and the ink liquid surface was adjusted to a level for image recording, so that each recording apparatus was laid in a standby state.

After that, a series sine wave of 50 MHz in frequency and 5 Vpp in voltage was applied as the ink liquid circulation signal (second driving signal) to one ink jet recording apparatus from the driving circuit 21 for 10 seconds. No ink liquid circulation signal was applied to the other ink jet recording apparatus. The same image data (first driving signal) was sent to these two ink jet recording apparatuses from the driving circuit 21 so as to carry out the printing. As a result of evaluation of recorded image points by 1,000 droplets, in the recording apparatus in which the ink liquid circulation motion was performed just before printing operation, all image points were successfully recorded with respect to the image recording signals. On the contrary, in the recording apparatus in which no ink liquid circulation motion was performed, at the initial phase of the printing, 3.3% was not injected and dot missing was generated in 21% area at the initial phase of the printing.

EXAMPLE 2

In this example, although the same ink jet recording apparatus as the example 1 was used, a so-called pigment ink containing a pigment as a coloring agent was used as the ink liquid. When the pigment ink is used, the driving voltage for forming and injecting ink droplets stably is 22 Vpp and the burst wave number is 1500.

Three ink jet recording apparatuses of the same type were prepared, and a pigment ink was filled therein. With the opening portions not covered, they were left as they were for three days. After that, no ink circulation signal was applied to one recording apparatus. To one ink jet recording apparatus of the other two ones was applied the ink liquid circulation signal after the ink liquid level was made equal to a level at the time of image formation standby. To the remainder one was applied the ink liquid circulation signal after the ink amount was adjusted so that the ink level was not in contact with the end of the opening portion of the upper lid. As the ink liquid circulation signal, a series sine wave of 50 MHz in frequency and 5 Vpp in voltage was applied like Example 1 for 20 seconds. When this ink liquid circulation signal was applied, no ink droplet was injected.

The above comparative procedure was carried out and the ink amount was adjusted to image formation standby state. The same image data (first driving signal) was sent to the three ink jet recording apparatuses and printing was carried out. As a result of evaluation of recorded image points by 1,000 droplets, in the recording apparatus in which the ink liquid circulation motion was carried out just before printing operation, with the ink level lowered relative to the level at the printing time, all image points were successfully recorded with respect to the recording signals. On the contrary, in the recording apparatus in which the ink liquid circulation motion was carried out without lowering the ink level, 1% was not injected at the initial phase of the printing and dot missing was generated in 4.7% area at the initial phase of the printing. Further, in the recording apparatus in which the ink liquid circulation motion was not carried out, 2.7% was not injected at the initial phase of the printing and dot missing was generated in a 13.8% area at the initial phase of the printing.

EXAMPLE 3

In this example, an ink jet recording apparatus having the same structure as shown in FIGS. 4 and 5 was produced as follows.

As the flat piezoelectric body 52, a lead titanate-based piezoelectric ceramic having a dielectric constant of 200 was used and the frequency was set to 50 MHz (50 mm in thickness). Then, a Ti/Ni/Au three-layer laminated electrode was formed on both surfaces of this piezoelectric body 52 by sputtering such that the thickness of each layer was 0.05 μm, 0.05 μm and 0.2 μm, respectively and then an electric field of 2 kV/mm was applied thereto to polarize the piezoelectric body. After that, array-like individual electrodes 53 were formed by etching, such that the width of one element was 60 μm and an interval between the electrodes was 25 μm (disposition pitch of the electrode, 85 μm). The effective bore of the piezoelectric element was 1.4 mm. The Ti/Au common electrode 54 was formed on this piezoelectric element by the electron beam evaporation method such that the thickness of each layer was 0.05 μm and 0.3 μm respectively.

On the other hand, the afore-mentioned piezoelectric element was bonded onto the glass substrate 51 of 1.1 mm in thickness on which the array electrodes 55 were disposed by using an epoxy-based adhesive, such that the individual electrodes 53 matched the array electrodes 55 on the glass substrate.

Next, to produce the Fresnel lens 58 acting as the acoustic matching layer at the same time, a mixture of an epoxy resin and an alumina powder was coated and hardened on the common electrode 54 in thickness of 45 $\mu$m under the condition in which the density was $2.20\times10^3$ kg/m and the sound velocity was $2.95\times10^3$ m/s and then grooves were cut at a predetermined pitch so as to have a focal distance of 3.3 mm. The driving circuit 56 was provided on the glass substrate 51 and connected to the respective electrodes 53, 54. By filling the ink liquid, the recording apparatus was completed.

An intermittent series sine wave (burst wave) was applied as shown in FIG. 6 to the piezoelectric element of this recording apparatus so as to form ink dots and as a result, an image was obtained. Meanwhile, burst wave interval was modified appropriately depending on the image data. In this embodiment, ink droplets were injected at an application voltage of 23 Vpp and a burst wave number of 1400.

To compare printed images depending on whether or not the ink circulation motion was carried out, three ink jet recording apparatuses of the same type were prepared and a pigment ink was filled therein. These recording apparatuses were left as they were for three days without covering the slits 59*a*. After that, to one of the recording apparatuses was applied no ink circulation signal (second driving signal), and to one of the other two ink jet recording apparatuses was applied the ink liquid circulation signal after the ink amount was made equal to image formation standby time. To the remainder one was applied the ink liquid circulation signal after the ink amount was adjusted so that the ink level was not in contact with the end of the slit 59*a*. The ink liquid circulation signal applied thereto was a series sine wave of 50 MHz in frequency and 6 Vpp in voltage like Example 1 and the application time was 20 seconds. When the ink circulation signal was applied, no ink droplet was injected.

After the above comparative procedure was carried out and the ink amount was adjusted to image formation standby state, the same image data (first driving signal) was sent to the above three ink jet recording apparatuses and printing was carried out. As a result of evaluation of recorded image points by 1,000 droplets, in the recording apparatus in which the ink liquid circulation motion was carried out just before printing operation, with the ink level lowered relative to the level at the printing time, all image points were successfully recorded with respect to the recording signals. On the contrary, in the recording apparatus in which the ink liquid circulation motion was carried out without lowering the ink level, 2.5% was not injected at the initial phase of the printing and dot missing was generated in a 7.6% area at the initial phase of the printing. Further, in the recording apparatus in which the ink liquid circulation motion was not carried out, 4.3% was not injected at the initial phase of the printing and dot missing was generated in 14.8% area at the initial phase of the printing.

As described above, according to the present invention, there is provided an ink jet recording apparatus capable of performing high quality image recording easily without using any special device even after a long down time.

While the invention has been described in detail and with reference to specific embodiments thereof, it will be apparent to one skilled in the art that various changes and modifications can be made therein without departing from the spirit and scope thereof.

What is claimed is:

1. An ink jet recording apparatus using a supersonic wave, comprising:

an ink holder configured to hold an ink liquid;

a supersonic wave generator composed of a piezoelectric element acoustically connected to said ink liquid;

a supersonic wave focusing element configured to focus supersonic waves generated from said piezoelectric element;

an ink injection driving means for applying a first driving signal to said piezoelectric element so that the focused supersonic waves inject an ink from a surface of the ink liquid; and an ink liquid circulation means for applying a second driving signal to said piezoelectric element so that an acoustic pressure of said focused supersonic waves on the surface of the ink liquid is made smaller than an acoustic pressure necessary for injecting the ink, causing the ink liquid to circulate within said ink holder, wherein said piezoelectric element comprises a plurality of sub-elements disposed in a direction substantially parallel to a direction of image recording, and wherein a group of said sub-elements are driven to focus supersonic waves generated therefrom, so that the focused supersonic waves inject an ink from the surface of the ink liquid, and to electronically scan the focused supersonic waves in a direction of disposal of said sub-elements, according to said first driving signal.

2. An ink jet recording apparatus according to claim 1, wherein said ink liquid circulation means applies said second driving signal when no image is recorded.

3. An ink jet recording apparatus according to claim 1, wherein said second driving signal has a lower voltage than said first driving signal.

4. An ink jet recording apparatus according to claim 1, wherein said first and second driving signals are given in the form of burst waves, said second driving signal having a smaller number of burst waves than said first driving signal.

5. An ink jet recording apparatus according to claim 1, wherein said second driving signal is given in the form of a continuous wave.

6. An ink jet recording apparatus according to claim 1, wherein a frequency of said second driving signal is within a resonant frequency range inherent of said piezoelectric element or harmonic component range thereof.

7. An ink jet recording apparatus according to claim 1, wherein a group of said sub-elements are driven to focus supersonic waves generated therefrom so that the focused supersonic waves circulate the ink liquid within said ink holder and to scan the focused supersonic waves in the direction of disposing said sub-elements electronically according to said second driving signal.

8. An ink jet recording apparatus according to claim 1, wherein said ink liquid circulation means applies said second driving signal when an ink level of the ink liquid is lower than that at the time of formation of images.

9. An ink jet recording apparatus according to claim 1, wherein said ink liquid contains a pigment as a coloring agent.

10. An ink jet recording apparatus using a supersonic wave, comprising:

an ink holder configured to hold an ink liquid;

a supersonic wave generator composed of a piezoelectric element acoustically connected to said ink liquid;

a supersonic wave focusing element configured to focus supersonic waves generated from said piezoelectric element;

an ink injection driving means for applying a first driving signal to said piezoelectric element so that the focused supersonic waves inject an ink from a surface of the ink liquid; and an ink liquid uniformity means for applying a second driving signal to said piezoelectric element so that an acoustic pressure of said focused supersonic waves on the surface of the ink liquid is made smaller than an acoustic pressure necessary for injecting the ink, making the ink liquid uniform, wherein said piezoelectric element comprises a plurality of sub-elements disposed in a direction substantially parallel to a direction of image recording, and wherein a group of said sub-elements are driven to focus supersonic waves generated therefrom, so that the focused supersonic waves inject an ink from the surface of the ink liquid, and to electronically scan the focused supersonic waves in a direction of disposal of said sub-elements, according to said first driving signal.

11. An ink jet recording apparatus according to claim 10, wherein said ink liquid uniformity means applies said second driving signal when no image is recorded.

12. An ink jet recording apparatus according to claim 10, wherein said second driving signal has a lower voltage than said first driving signal.

13. An ink jet recording apparatus according to claim 10, wherein said first and second driving signals are given in the form of burst waves, said second driving signal having a smaller number of burst waves than said first driving signal.

14. An ink jet recording apparatus according to claim 10, wherein said second driving signal is given in the form of a continuous wave.

15. An ink jet recording apparatus according to claim 10 wherein a frequency of said second driving signal is within a resonant frequency range inherent of said piezoelectric element or harmonic component range thereof.

16. An ink jet recording apparatus according to claim 10, wherein a group of said sub-elements are driven to focus supersonic waves generated therefrom so that the focused supersonic waves make the ink liquid uniform and to scan the focused supersonic waves in the direction of disposing said sub-elements electronically according to said second driving signal.

17. An ink jet recording apparatus according to claim 10, wherein said ink liquid uniformity means applies said second driving signal when an ink level of the ink liquid is lower than that at the time of formation of images.

18. An ink jet recording apparatus according to claim 10, wherein said ink liquid contains a pigment as a coloring agent.

19. An ink jet recording apparatus using a supersonic wave, comprising:

an ink holder configured to hold an ink liquid;

a supersonic wave generator composed of a piezoelectric element acoustically connected to said ink liquid;

a supersonic wave focusing element configured to focus supersonic waves generated from said piezoelectric element;

an ink injection driving means for applying a first driving signal to said piezoelectric element so that the focused supersonic waves inject an ink from a surface of the ink liquid; and an ink liquid circulation means for applying a second driving signal to said piezoelectric element so that an acoustic pressure of said focused supersonic waves on the surface of the ink liquid is made smaller than an acoustic pressure necessary for injecting the ink, causing the ink liquid to circulate within said ink holder, wherein said ink liquid circulation means applies said second driving signal when an ink level of the ink liquid is lower than that at the time of formation of images.

20. An ink jet recording apparatus using a supersonic wave, comprising:

an ink holder configured to hold an ink liquid;

a supersonic wave generator composed of a piezoelectric element acoustically connected to said ink liquid;

a supersonic wave focusing element configured to focus supersonic waves generated from said piezoelectric element;

an ink injection driving means for applying a first driving signal to said piezoelectric element so that the focused supersonic waves inject an ink from a surface of the ink liquid; and an ink liquid uniformity means for applying a second driving signal to said piezoelectric element so that an acoustic pressure of said focused supersonic waves on the surface of the ink liquid is made smaller than an acoustic pressure necessary for injecting the ink, making the ink liquid uniform, wherein said ink liquid uniformity means applies said second driving signal when an ink level of the ink liquid is lower than that at the time of formation of images.

* * * * *